US005531421A

United States Patent [19]

Fenner

[11] Patent Number: 5,531,421

[45] Date of Patent: Jul. 2, 1996

[54] ANNULAR DAM SLIDE VALVE

[75] Inventor: Thomas Fenner, Eschborn, Germany

[73] Assignee: Hoechst Aktiengesellschaft, Frankfurt am Main, Germany

[21] Appl. No.: 308,496

[22] Filed: Sep. 21, 1994

[30] Foreign Application Priority Data

Sep. 23, 1993 [DE] Germany ..... 43 32 295.6

[51] Int. Cl.[6] ..... F16K 31/08

[52] U.S. Cl. ..... 251/65; 251/343

[58] Field of Search ..... 251/129.21, 317, 251/129.01, 65, 341, 343, 347

[56] References Cited

U.S. PATENT DOCUMENTS

| | | | |
|---|---|---|---|
| 3,321,177 | 5/1967 | Fendel et al. | 251/129.21 X |
| 3,833,015 | 9/1974 | Kneuer | 251/129.21 X |
| 4,948,091 | 8/1990 | Satoh et al. | 251/129.21 X |
| 5,351,934 | 10/1994 | Jensen et al. | 251/129.21 X |

FOREIGN PATENT DOCUMENTS

| | | |
|---|---|---|
| 214856 | 4/1961 | Germany . |
| 144034 | 9/1980 | Germany . |
| 212719 | 8/1984 | Germany . |

OTHER PUBLICATIONS

English language abstract of German Patent Appln. No. 144 034.

English language abstract of German Patent Appln. No. 212 719.

European Search Report for European Patent Appln. No. 94113884.4 dated Dec. 7, 1994.

*Primary Examiner*—Kevin Lee

*Attorney, Agent, or Firm*—Finnegan, Henderson, Farabow, Garrett & Dunner

[57] ABSTRACT

In the annular dam slide valve there is arranged in a tube (4) a lining tube (3) which is slidingly reciprocatable in the direction of the axis of said tube (4) and which lies against the inner wall of said tube (4). An actuating device (5, 6, 7) for the lining tube (3) is provided, and the tube (4) is provided at one end with a hopper (2) on which supports (10) are arranged which carry a pyramidal roof (displacement body) (1) which has peripheral eaves (8).

4 Claims, 1 Drawing Sheet

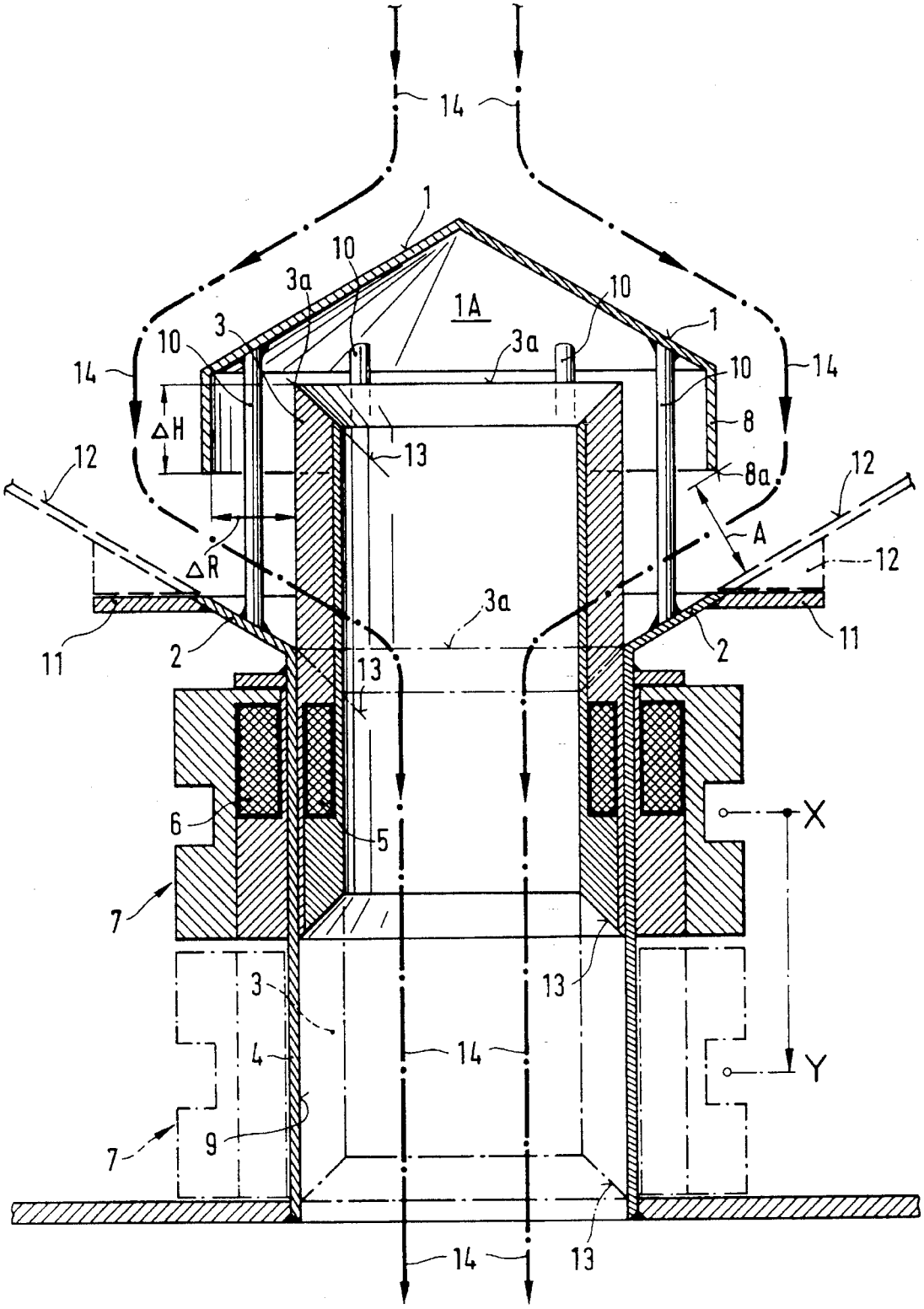
14
1
10
3a
1A
10
3
1
10
3a
14
10
14
ΔH
8
13
12
8a
12
A
ΔR
12
3a
11
2
2
11
13
6
5
X
7
13
3
4
14
Y
9
7
14
13

ANNULAR DAM SLIDE VALVE

The invention relates to an annular dam slide valve for interrupting streams of bulk material flowing through the force of gravity.

The interruption of streams of bulk material flowing vertically through the force of gravity in completely filled cross-sections, by means of known devices, such as for example flap valves, slide valves or pinch valves, usually results in the destruction of individual particles of the bulk material when the latter are sensitive to mechanical stress, such as for example tablets, capsules, coated tablets, electronic components, glass parts and the like.

The object is, therefore, to provide a shut-off device with which the mechanical stressing of fragile bulk material is avoided.

The object is achieved with an annular dam slide valve wherein in a tube there is arranged a lining tube which is slidingly reciprocatable in the direction of the axis of said tube and which lies against the inner wall of said tube, and wherein an actuating device for the lining tube is provided and the tube is provided at one end with a hopper on which supports are arranged which carry a pyramidal roof (displacement body) provided with peripheral eaves.

A flange may be arranged on the free edge of the hopper. The actuating device for the lining tube may consist of an electromagnetic, hydraulic, pneumatic or mechanical drive. The lining tube may have inwardly bevelled edges. The annular dam slide valve can be fastened by welding or flanging to the bulk material container, it being expedient for the inclination of the hopper, the inclination of the bevelled edges of the lining tube and the inclination of the bottom of the container to be adapted to one another. The tube, and therefore the lining tube and the roof, may have rectangular, square, equilateral polygonal or circular cross-sections.

The advantages of the device according to the invention are to be seen essentially in that the annular dam slide valve needs no pinch edges and seals and that only slight forces are required for its actuation. For cleaning purposes the lining tube can easily be removed by being pulled out.

The invention is explained in more detail below with reference to a drawing which illustrates only one embodiment and shows the annular dam slide valve in a sectional view. The solid lines in the drawing show the stream of bulk material interrupted, and the dot-dash lines show operation with the stream of bulk material flowing.

In a tube 4 a lining tube 3 is arranged which is slidingly reciprocatable in the direction of the axis of the tube 4. The lining tube 3 lies against the inner wall 9 of the tube 4. For the lining tube 3 the annular dam slide valve has an actuating device 5, 6, 7, which according to the figure consists of a drive 7 having an axial magnetic coupling 5, 6. The drive 7 is movable between a position X and a position Y to move the lining tube 3, via magnetic coupling 5, 6, between a closed position (indicated by the solid lines for the drive 7 and lining tube 3) and an open position (indicated by the dot-dash lines for the drive 7 and lining tube 3), respectively. In the case of a mechanical, hydraulic or pneumatic drive the tube 4 may be provided with a slideway engaging with and guiding a driver for the lining tube 3 (not illustrated). One end of the tube 4 is provided with a hopper 2, on which are arranged supports 10 which carry a pyramidal roof 1 functioning as a displacement body. The roof 1 may have peripheral eaves 8. At the free end of the hopper 2 a flange 11 may be arranged. 12 designates the bottom of the container, to which the annular dam slide valve is fastened, and 13 designates the bevelled edges of the lining tube 3.

The delivery stream 14 moves around the pyramidal roof 1, via the hopper 2 towards a vertically movable lining tube 3 and through the lining tube 3 when in the open position, and passes out of the annular dam slide valve through the tube 4. For the purpose of interrupting the stream 14 the lining tube 3 is pushed into the cavity 1A of the roof 1 and thus forms the annular dam. Since the bulk material penetrates only partially into the cavity 1A of the roof 1, on the insertion of the lining tube 3 into the cavity 1A of the roof 1 the particles can escape without being damaged. The difference in height $\Delta h$ between the top edge 3*a* of the lining tube 3 and the bottom edge 8*a* of the caves 8 cannot be overcome by the stream of product, and the movement of the latter comes to a halt. The difference $\Delta R$ (width of annular space) between the inside radius of the roof 1 and the outside radius of the lining tube 3, the distance A between the bottom edge 8*a* of the eaves and the hopper 2, and the angles to be respected depend on the particle size and the flow properties of the product to be handled.

I claim:

1. An annular dam slide valve, comprising:

a tube having an internal passageway and a first opening;

a hopper adjacent the first opening of the tube;

a pyramidal roof, having peripheral eaves, supported within the hopper and above the first opening, the roof and hopper defining a flow path through the first opening and into the passageway;

a lining tube within the tube and coaxial with the passageway, the lining tube slidingly reciprocatable in an axial direction of the tube and movable between a first position for blocking the flow path and a second, unblocked position; and an actuating device for moving the lining tube between the first and second positions.

2. The annular dam slide valve as claimed in claim 1, wherein a flange is arranged on a free edge of the hopper.

3. The annular dam slide valve as claimed in claim 1 or 2, wherein the actuating device for the lining tube includes a drive movable relative to the tube and coupled to the lining tube via an axial magnetic coupling.

4. The annular dam slide valve as claimed in claim 1, wherein the lining tube has inwardly bevelled edges.

* * * * *